US012442265B2

(12) United States Patent
Romero et al.

(10) Patent No.: US 12,442,265 B2
(45) Date of Patent: Oct. 14, 2025

(54) DIFFUSER AND FILTER ASSEMBLIES WITH MAGNETIC FEATURES

(71) Applicant: Downhole Rental Tools, LLC, Broussard, LA (US)

(72) Inventors: Cambre Allen Romero, Broussard, LA (US); Clayton Allen Romero, Broussard, LA (US)

( * ) Notice: Subject to any disclaimer, the term of this patent is extended or adjusted under 35 U.S.C. 154(b) by 0 days.

(21) Appl. No.: 18/281,713

(22) PCT Filed: Mar. 11, 2022

(86) PCT No.: PCT/US2022/020004

§ 371 (c)(1),
(2) Date: Sep. 12, 2023

(87) PCT Pub. No.: WO2022/192707

PCT Pub. Date: Sep. 15, 2022

(65) Prior Publication Data

US 2024/0159119 A1 May 16, 2024

Related U.S. Application Data

(60) Provisional application No. 63/160,312, filed on Mar. 12, 2021.

(51) Int. Cl.
*E21B 31/06* (2006.01)
*E21B 17/10* (2006.01)

(52) U.S. Cl.
CPC ..... *E21B 31/06* (2013.01); *E21B 17/1078* (2013.01)

(58) Field of Classification Search
CPC ..... E21B 31/06; E21B 37/00; E21B 43/086; E21B 21/003; E21B 17/1078; E21B 37/02; E21B 31/00; E21B 37/045
See application file for complete search history.

(56) References Cited

U.S. PATENT DOCUMENTS

| | | | | |
|---|---|---|---|---|
| 3,633,674 | A | 1/1972 | Brieger | |
| 6,655,462 | B1 | 12/2003 | Carmichael et al. | |
| 8,376,058 | B2 | 2/2013 | Adamson | |
| 8,800,660 | B2 | 8/2014 | Fishbeck et al. | |
| 9,227,198 | B2 | 1/2016 | Branch | |
| 10,208,553 | B2 * | 2/2019 | Sullivan | E21B 31/06 |
| 10,677,019 | B2 | 6/2020 | Romero et al. | |
| 2007/0085645 | A1 | 4/2007 | Ruttley | |
| 2011/0284211 | A1 | 11/2011 | Hern et al. | |
| 2014/0096972 | A1 | 4/2014 | Leiper et al. | |

(Continued)

*Primary Examiner* — Daniel P Stephenson
(74) *Attorney, Agent, or Firm* — Warner J. Delaune; Phelps Dunbar LLP

(57) ABSTRACT

An external filter assembly is shown having a slotted filter section, including an optional upper collar attached below the mounting member, and lower collar attached below the bottom cap of a lower filter element, where each collar includes a plurality of extensions containing magnets. Specifically, in the case of each extension, a bore is formed longitudinally within the extension, and a diametrically magnetic rare earth (neodymium) high-temperature rated magnet is permanently installed within the bore. Thus, with magnets installed in all of the extensions, metal debris passing through the assembly at any location, whether the upper collar or lower collar, is likely to be attracted to and retained by the extensions.

7 Claims, 24 Drawing Sheets

(56) References Cited

U.S. PATENT DOCUMENTS

| | | | | |
|---|---|---|---|---|
| 2019/0063170 | A1* | 2/2019 | Romero | E21B 43/086 |
| 2020/0270957 | A1 | 8/2020 | Romero et al. | |
| 2021/0148178 | A1 | 5/2021 | Confield et al. | |
| 2024/0159119 | A1* | 5/2024 | Romero | E21B 31/06 |

* cited by examiner

DIFFUSER AND FILTER ASSEMBLIES WITH MAGNETIC FEATURES

REFERENCE TO RELATED APPLICATIONS

This application is a national stage application under 35 U.S.C. Section 371 of International Patent Application No. PCT/US2022/020004 filed on 11 Mar. 2022, which in turn claims the benefit of U.S. Provisional Patent Application No. 63/160,312, filed on 12 Mar. 2021, the disclosures of which are incorporated herein by reference.

BACKGROUND OF THE INVENTION

1. Field of the Invention

The present invention relates in part to devices and methods used in oil and gas drilling operations to filter materials and diffuse aggregations of lost circulation materials (LCM) which are used to resolve lost circulation and fluid losses, and more particularly to such devices which include magnetic elements for capturing metal debris passing through the device to protect sensitive tools and equipment below the device.

2. Prior Art

When drilling oil and gas wells, under proper conditions during the drilling process, drilling fluids and drill cuttings are circulated away from the drill bit into the annulus around the drill stem and brought to the surface. Such drilling fluids are also important for providing hydrostatic pressure to prevent formation fluids from entering into the well bore, keeping the drill bit cool and clean during drilling, and suspending the drill cuttings while drilling is paused and when the drilling assembly is brought in and out of the hole. Because proper circulation is critical to the drilling process, any lost circulation is a significant problem that must be overcome for drilling to recommence.

Lost circulation is the partial or complete loss of drilling fluid or cement slurry to the formation during drilling or cementing operations or both. Lost circulation can be brought on by natural causes, such as naturally fractured formations or unconsolidated zones, or induced causes, such as when the hydrostatic fluid column pressure exceeds the fracture gradient of the formation and the formation pores break down enough to receive (rather than resist) the fluid. When lost circulation occurs, it typically results in the new expenditure of time and mud or cement, adding substantially to the overall cost of a well.

The consequences of lost circulation can be as little as the loss of a few dollars of drilling fluid, or as disastrous as a blowout and loss of life. If the amount of fluid in the well bore drops due to lost circulation (or any other reason), hydrostatic pressure is reduced, which can allow a gas or fluid which is under a higher pressure than the reduced hydrostatic pressure to flow into the well bore. Another consequence of lost circulation is dry drilling. Dry drilling occurs when fluid is completely lost from the well bore without actual drilling coming to a stop. The effects of dry drilling range from as minor as destroying a bit to as serious as major damage to the well bore requiring a new well to be drilled. Dry drilling can also cause severe damage to the drill string, including snapping the pipe, and the drilling rig itself.

Lost circulation material (LCM) is the collective term for substances added to drilling fluids when drilling fluids are being lost to the formations downhole. Commonly used LCM types include fibrous (cedar bark, shredded cane stalks, mineral fiber and hair), flaky (mica flakes and pieces of plastic or cellophane sheeting) or granular (ground and sized limestone or marble, wood, nut hulls, Formica, corncobs and cotton hulls). The LCM, in combination with other fluids with increased viscosity, are used to fill fractures and heal the loss zone quickly.

As the LCM is delivered to the loss zone, accumulations and aggregations of the LCM can occur which may obstruct the necessary flow of fluids to the site. Therefore, it is desirable to prevent such obstructions by diffusing such aggregations or "clumps" as early and as quickly as possible. Given the nature of some types of LCM and their tendency to aggregate into such clumps, one solution is to cause such clumps to contact diffusing members placed into the fluid path, but while not substantially decreasing the proper fluid flow during the healing process of the loss zone.

In addition to diffusion near the loss zone, there is also a need for diffusion of LCM clumps that form as the fluids are delivered through the drill pipe at the rig floor, as well as diffusion of LCM clumps which may form after leaving the mixing tank where the LCM is added to the drilling fluids. Furthermore, once drilling operations are concluded, the diffuser can also be deployed in various locations for diffusion in completion and workover operations.

A further need exists for diffusers and filters to capture ferrous-based metal debris that can otherwise reach sensitive tools and equipment below the filter or diffuser. Therefore, the incorporation of magnetic elements into the filters and diffusers serve to attract and retain the metal debris to prevent the debris from harming such equipment and causing costly repairs.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs. Unless otherwise specified herein, all materials of construction are preferably steel resistant to the corrosive effects common in oil and gas production environments. As used herein the term "conduit" shall mean any tubular member into which the diffuser 1 or filter can be installed for the purpose of allowing LCM-containing fluid to flow through the conduit and be broken apart, or diffused, by the diffuser 1. Non-limiting examples of conduits may be a carrier sub, drill pipe, stabilizer, or other tubular member such as shown in the figures.

This invention builds upon and introduces novel features based upon related devices developed by the applicants, including the following U.S. Pat. Nos. 10,053,960, 10,648,256, 10,677,019, 10,927,646, and 11,047,181. The disclosures of all of these patents are hereby incorporated by reference into this application.

For the purposes of this application, the term "external" used with descriptions of filter assemblies means that fluid flow is external to the filter prior to entering the filter assembly for filtration. The term "internal" used with descriptions of filter assemblies means that fluid flow is inside the filter assembly and flows out of the filter assembly after filtration.

For the purposes of this application, the term "external" used with descriptions of diffuser assemblies means that the diffusing action is achieved by diffusing elements located external to a central member or conduit. The term "internal" used with descriptions of diffuser assemblies means that the diffusing action is achieved by diffusing elements located internal to a central member or conduit.

Turning now to the figures, a number of preferred and alternate embodiments of the present invention are shown in FIGS. 1-15 which all employ magnetic elements to help capture ferrous metal debris in a variety of environments in the oil and gas industry.

Figure 1:
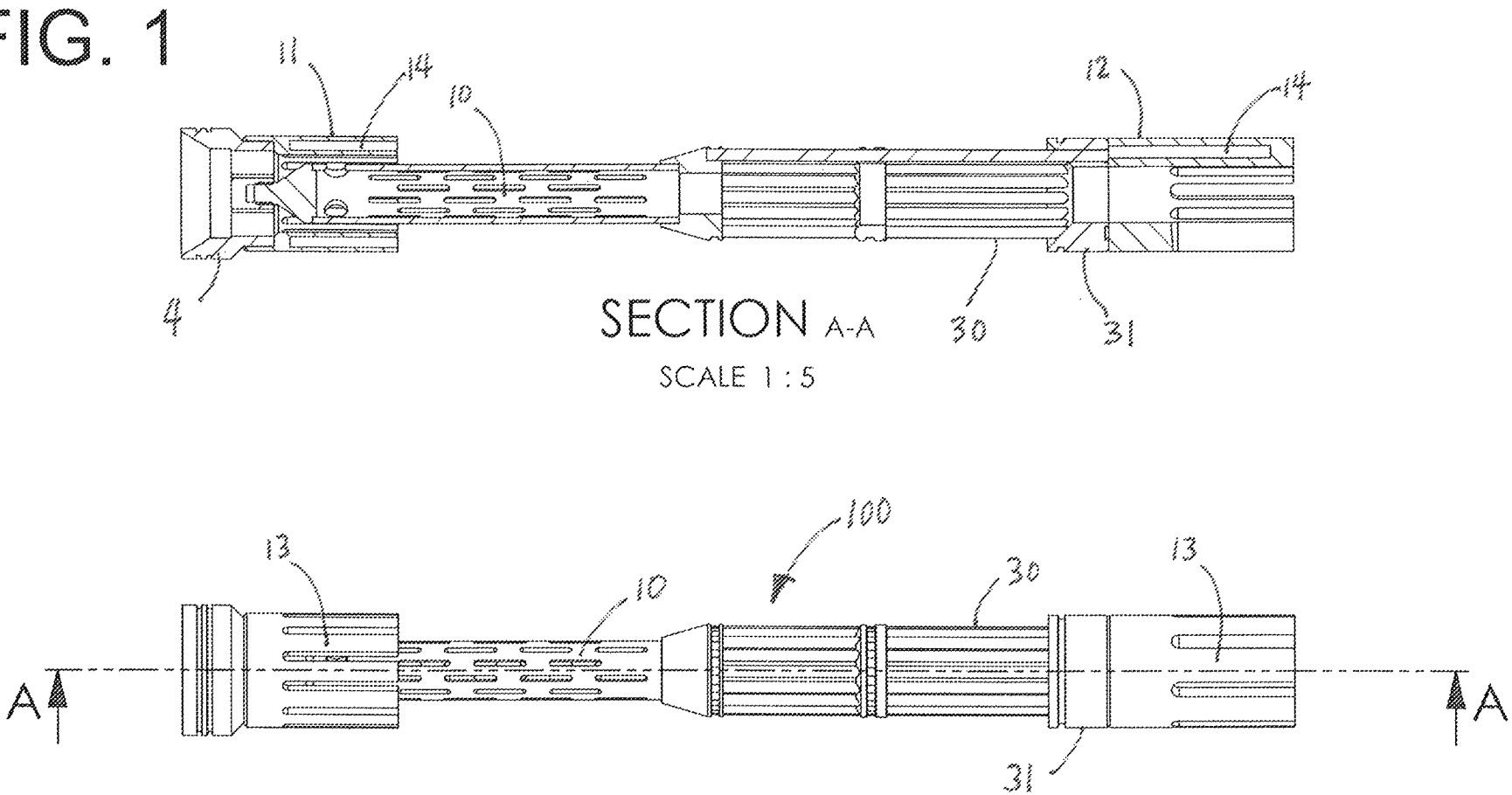
FIG. 1 shows an external filter assembly having a slotted filter section, including an optional upper and lower collar, where each collar includes a plurality of extensions containing magnets.

With reference to FIG. 1, an external filter assembly 100 is shown having a slotted filter section 10, including an optional upper collar 11 attached below the mounting member 4, and lower collar 12 attached below the bottom cap 31 of a lower filter element 30, where each collar 11, 12 includes a plurality of extensions 13 containing magnets 14. Specifically, in the case of each extension 13, a bore is formed longitudinally within the extension 13, and a diametrically magnetic rare earth (neodymium) high-temperature rated magnet 14 is permanently installed within the bore. Thus, with magnets 14 installed in all of the extensions 13, metal debris passing through the assembly 100 at any location, whether the upper collar 11 or lower collar 12, is likely to be attracted to and retained by the extensions 13. Unless otherwise specified herein, all descriptions which include the use of magnets involves magnets having the same or similar magnetic properties, regardless of their physical form factor or location on any of the embodiments disclosed herein.

Figure 2:
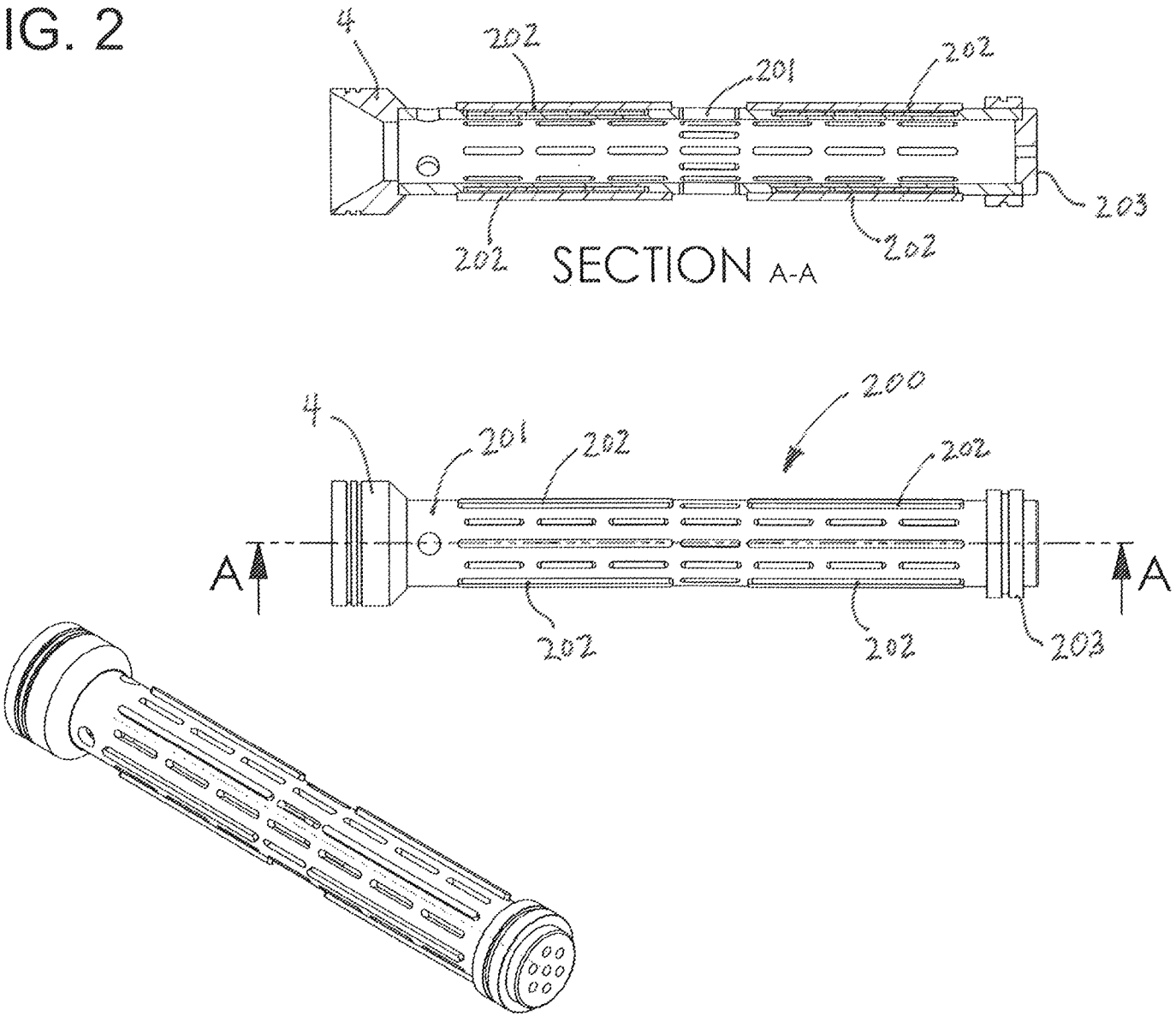
FIG. 2 shows an internal filter assembly having a slotted central conduit which includes a plurality of magnets aligned with the slots, and including an optional end cap.

With reference to FIG. 2, an internal filter assembly 200 is shown having a slotted central conduit 201 below a mounting member 4, and which includes a plurality of magnets 202 aligned with the slots and positioned around the external periphery of the central conduit 201. The magnets 202 may be removably attached or may be permanently installed on the central conduit 201. Thus, with magnets 202 installed along the length of the central conduit 201, metal debris passing through the assembly 200 at any location is likely to be attracted to and retained by the magnets 202. The precise number and positioning of the magnets 202 will depend upon the extent of metal debris encountered in the particular environment and the need to protect equipment present below the assembly 200. Depending upon the needs of the situation, and end cap 203 is also optionally installed.

Figure 3:
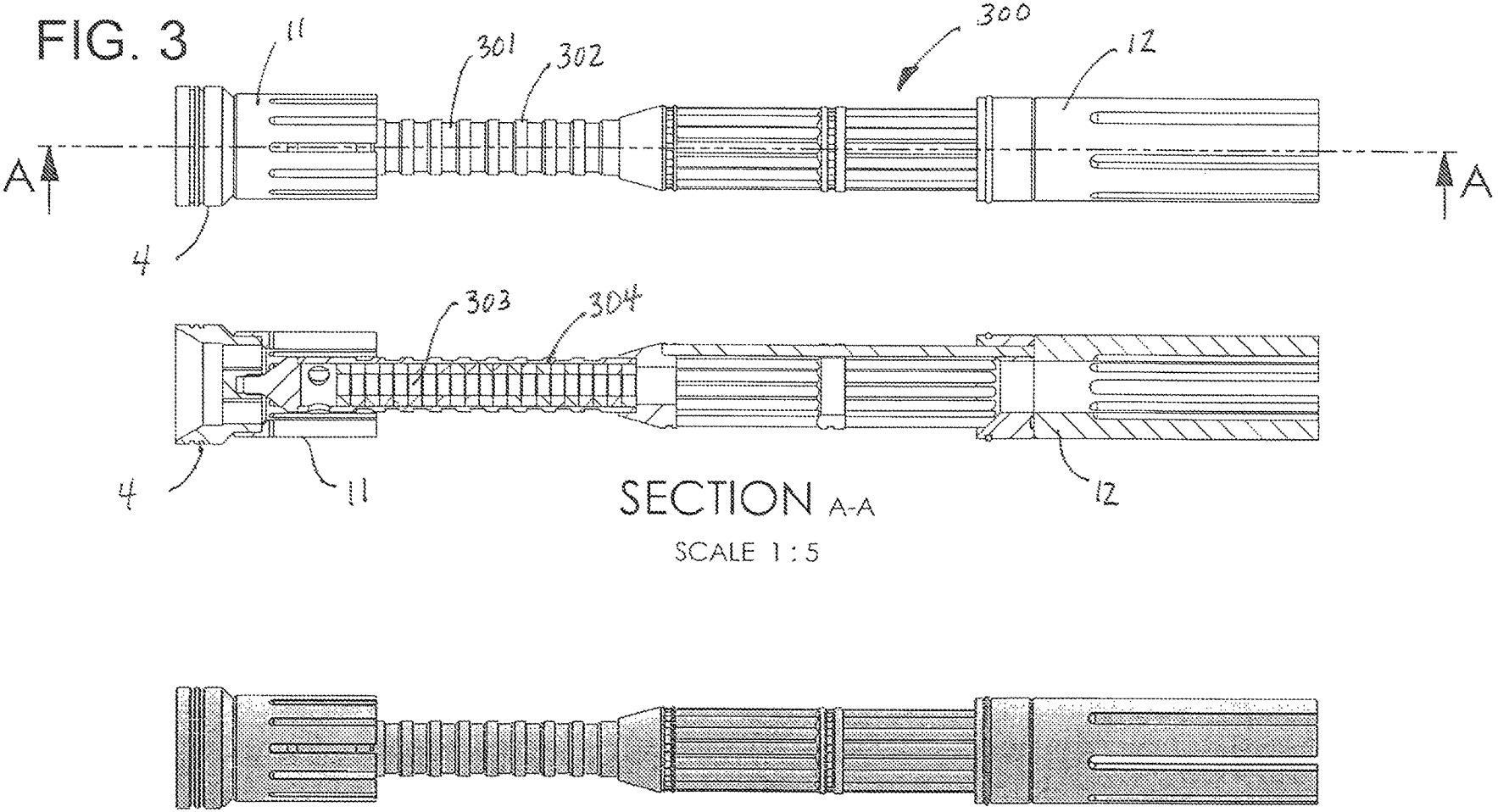
FIG. 3 shows an external filter assembly having a central member which includes a ribbed profile, and which further includes one or more magnets within an enclosed chamber in the central member, and further including an optional upper and lower collar, where each collar includes a plurality of extensions containing magnets.

With reference to FIG. 3, an external filter assembly 300 is shown having a central member 301 which includes a ribbed profile 302, and which further includes one or more magnets 303 within an enclosed chamber 304 in the central member 301. This embodiment also includes an optional upper and lower collar 11, 12 with magnetic extensions 13 similar to those described and seen in FIG. 1. Metal debris passing on the exterior surface of the ribbed profile 302 will be attracted to and retained by the magnets 303, as well as on the extensions 13 of collars 11, 12.

Figure 4A:
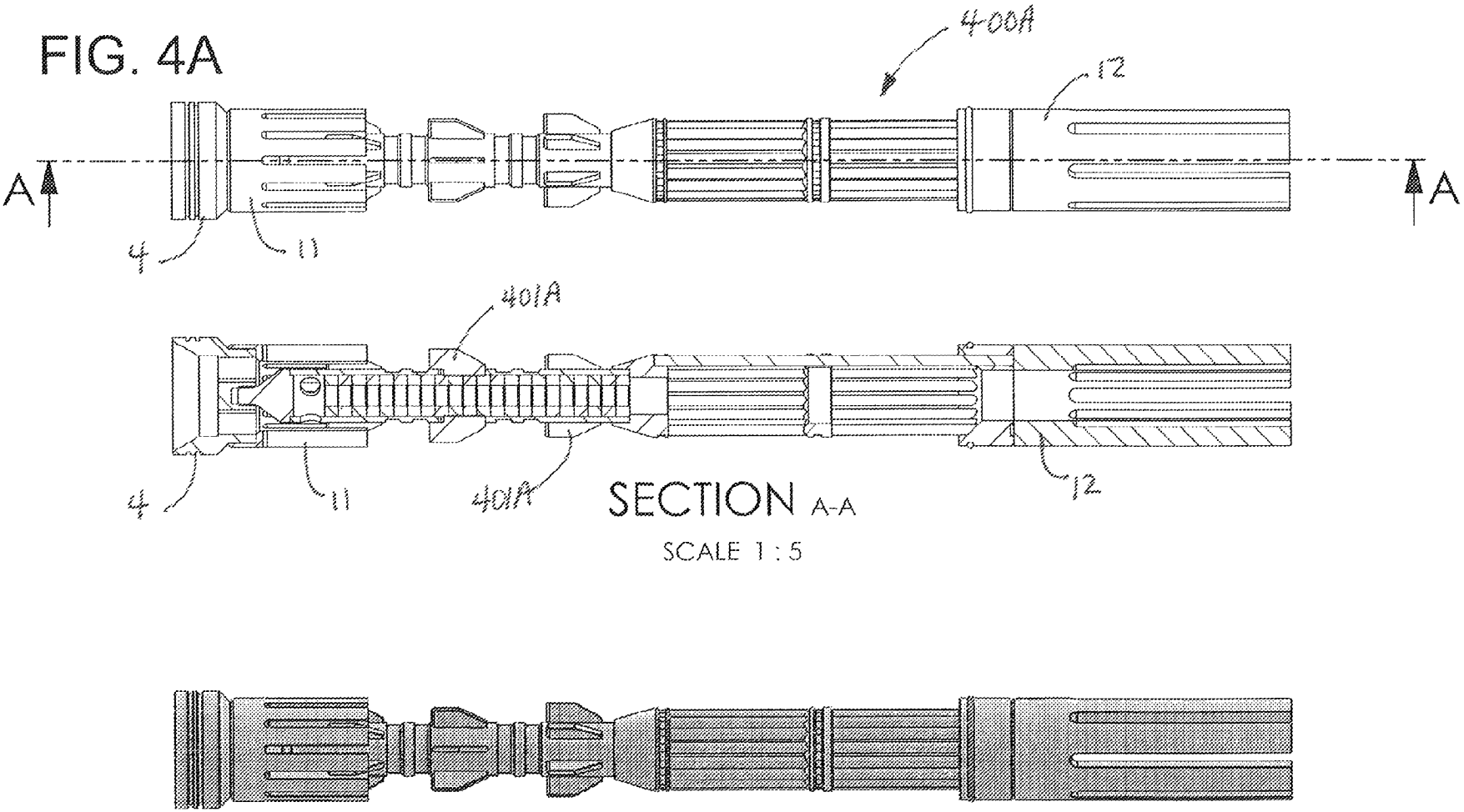
FIG. 4A shows an external diffuser assembly having a central member which includes a ribbed profile, and which further includes one or more magnets within an enclosed chamber in the central member, and further including an optional upper and lower collar, where each collar includes a plurality of extensions containing magnets.

With reference to FIG. 4A, an external diffuser assembly 400A is shown having a central member, ribbed profile, chamber, and magnets 303 similar to the embodiment of FIG. 3, as well as magnetic upper and lower collars 11, 12 as described above. However, diffusing elements 401A are also attached to the central member 301 for diffusing action as previously disclosed.

Figure 4B:
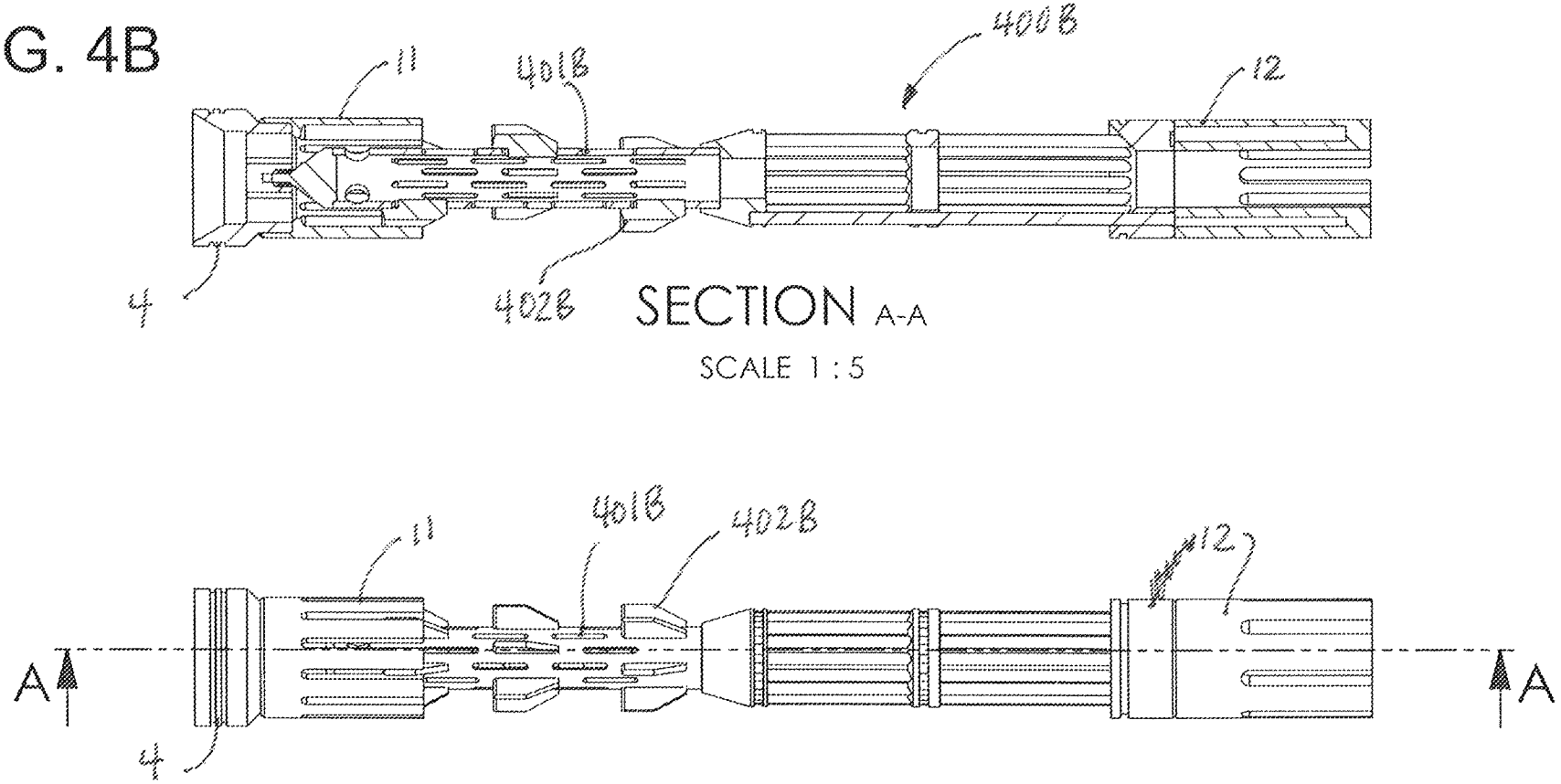
FIG. 4B shows an external diffuser assembly having a slotted diffuser section, including an optional upper and lower collar, where each collar includes a plurality of extensions containing magnets.

With reference to FIG. 4B, this embodiment 400B is similar to the embodiment of FIG. 4A, but rather than the central member with magnets, the assembly includes a slotted external diffuser section 401B with diffusing elements 402B.

Figure 4C:
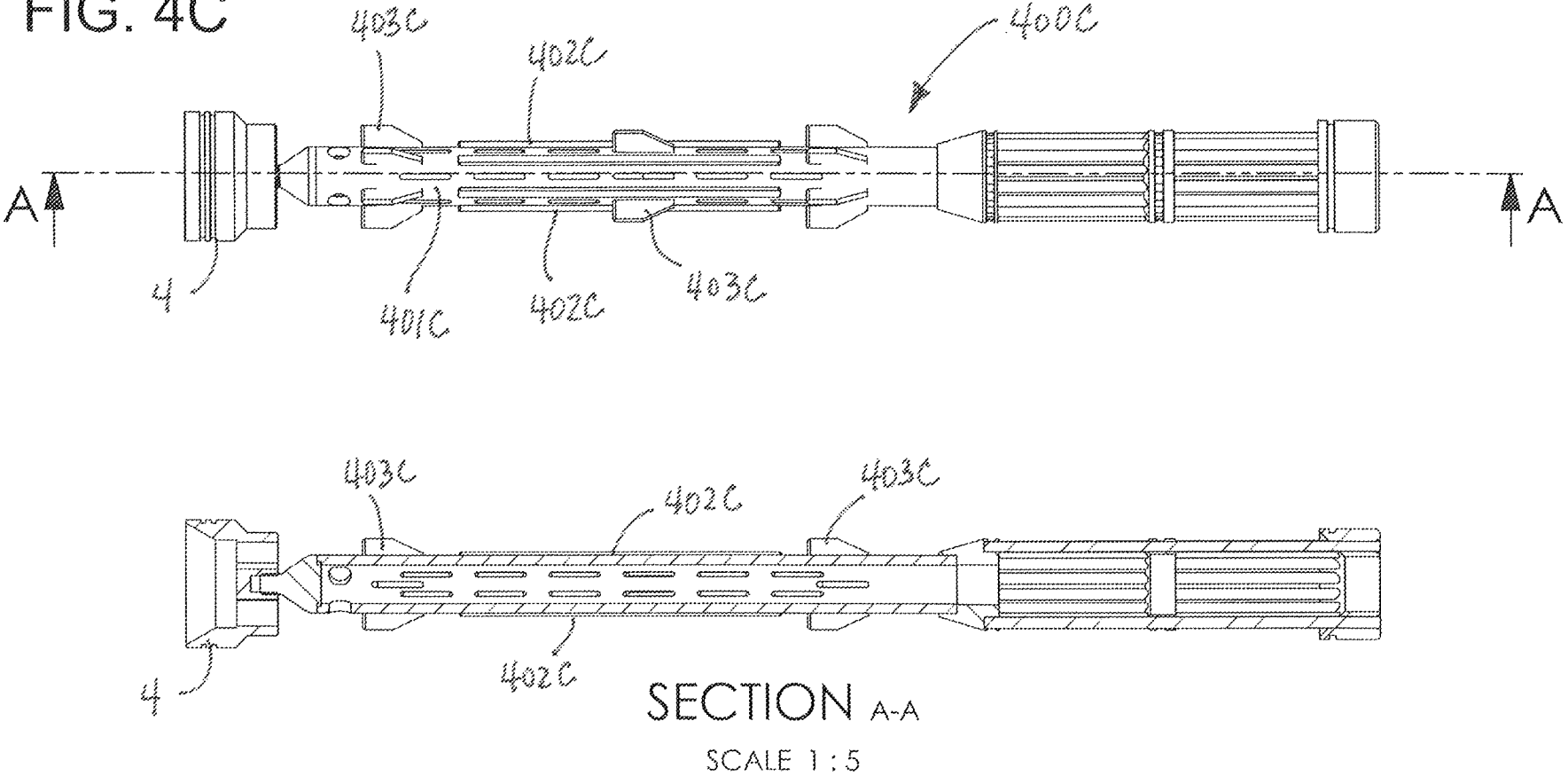
FIG. 4C shows an external diffuser assembly having a slotted diffuser section which includes a plurality of magnets aligned with the slots.

With reference to FIG. 4C, an external diffuser assembly 400C is shown having a slotted diffuser section 401C which includes a plurality of elongated magnets 402C aligned with the slots, similar to the arrangement seen in the internal filter 200 of FIG. 2, in addition to the diffusing elements 403C.

Figure 5:
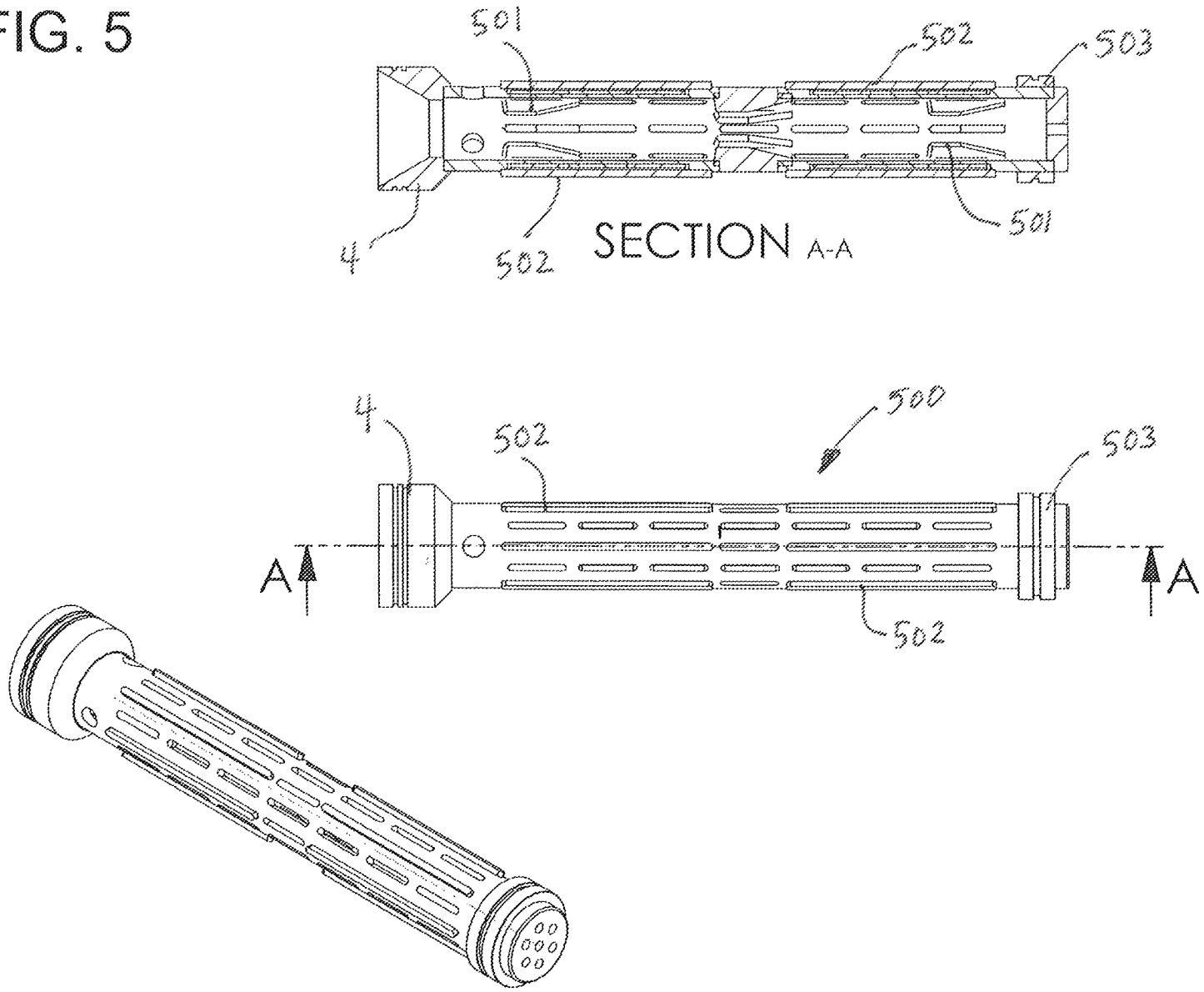
FIG. 5 shows an internal diffuser assembly which includes a plurality of magnets aligned with the slots, and including an optional end cap.

With reference to FIG. 5, an internal diffuser assembly 500 is shown which is similar to the internal filter 200 of FIG. 2, along with an optional end cap 503, but which also includes internal diffusing elements 501, in addition to the elongated magnets 502 positioned on the exterior of the assembly.

Figure 6A:
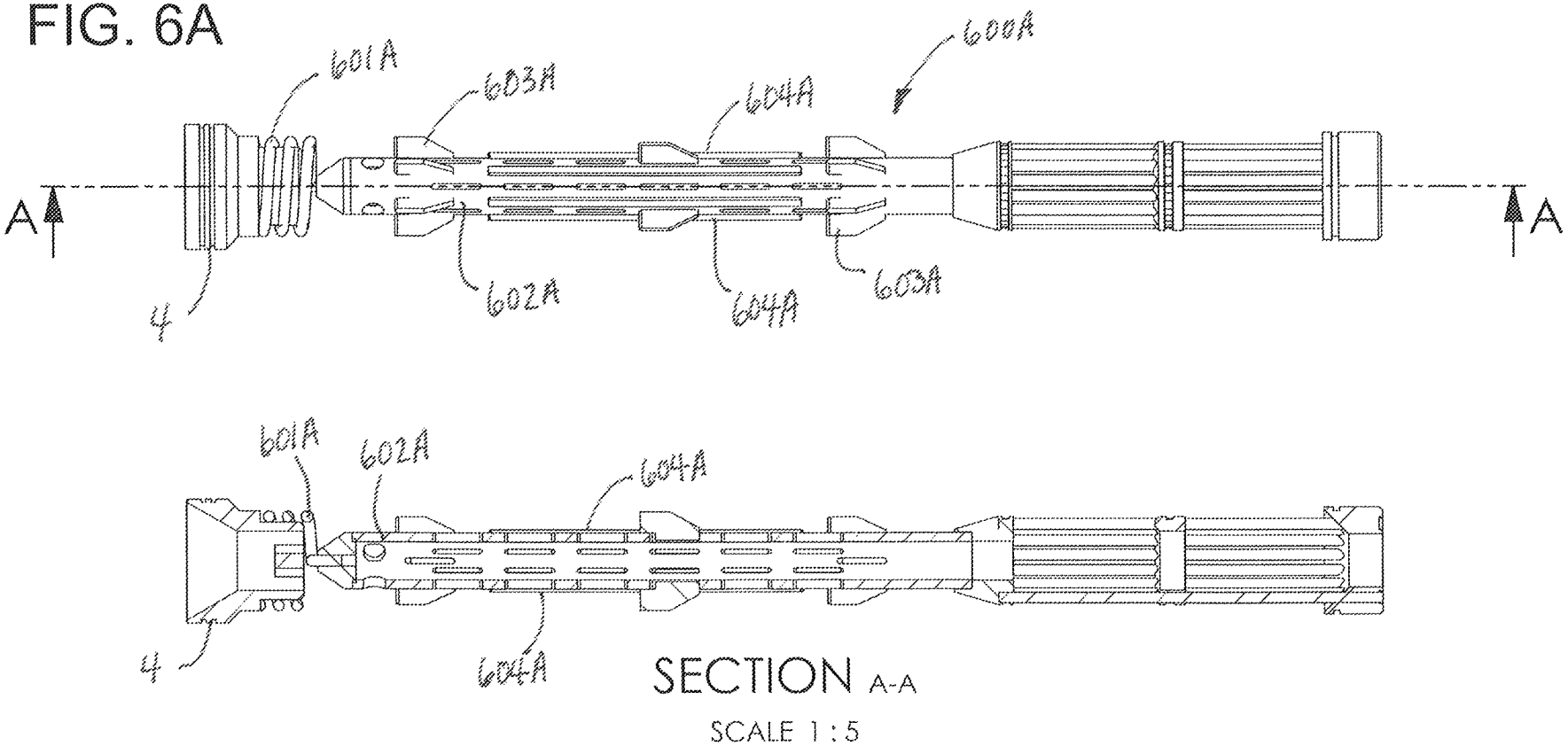
FIG. 6A shows an external diffuser assembly which includes a resilient member to enable a vibration feature, and having a slotted diffuser section which includes a plurality of magnets aligned with the slots.

With reference to FIG. 6A, an external diffuser assembly 600A is shown which includes a resilient member 601A extending from the mounting member 4 to enable a vibration feature as previously described in the applicants' other patents and applications incorporated herein, and having a slotted diffuser section 602A which includes external diffusing elements 603A and a plurality of elongated magnets 604A aligned with the slots, also as previously described herein.

Figure 6B:
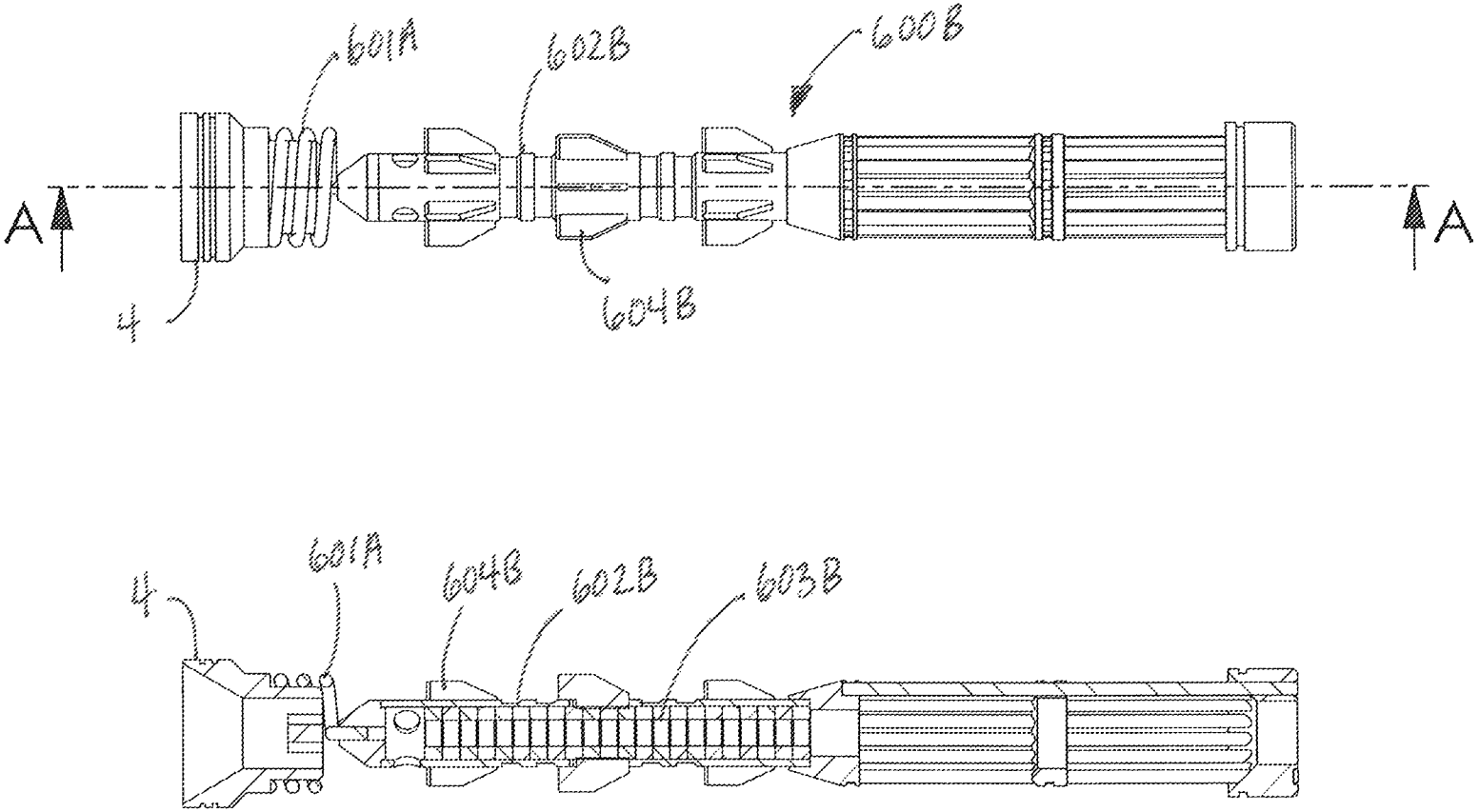
FIG. 6B shows an external diffuser assembly which includes a resilient member to enable a vibration feature, and having a central member which includes a ribbed profile, and which further includes one or more magnets within an enclosed chamber in the central member.

With reference to FIG. 6B, an external diffuser assembly 600B is shown which is similar in most respects to the embodiment 600A of FIG. 6A, but which replaces the slotted diffuser section 602A with a ribbed profile central member 602B, internal magnets 603B, and diffusing elements 604B identical to that seen in other embodiments previously described herein, such as in embodiment 400A in FIG. 4A.

Figure 7:
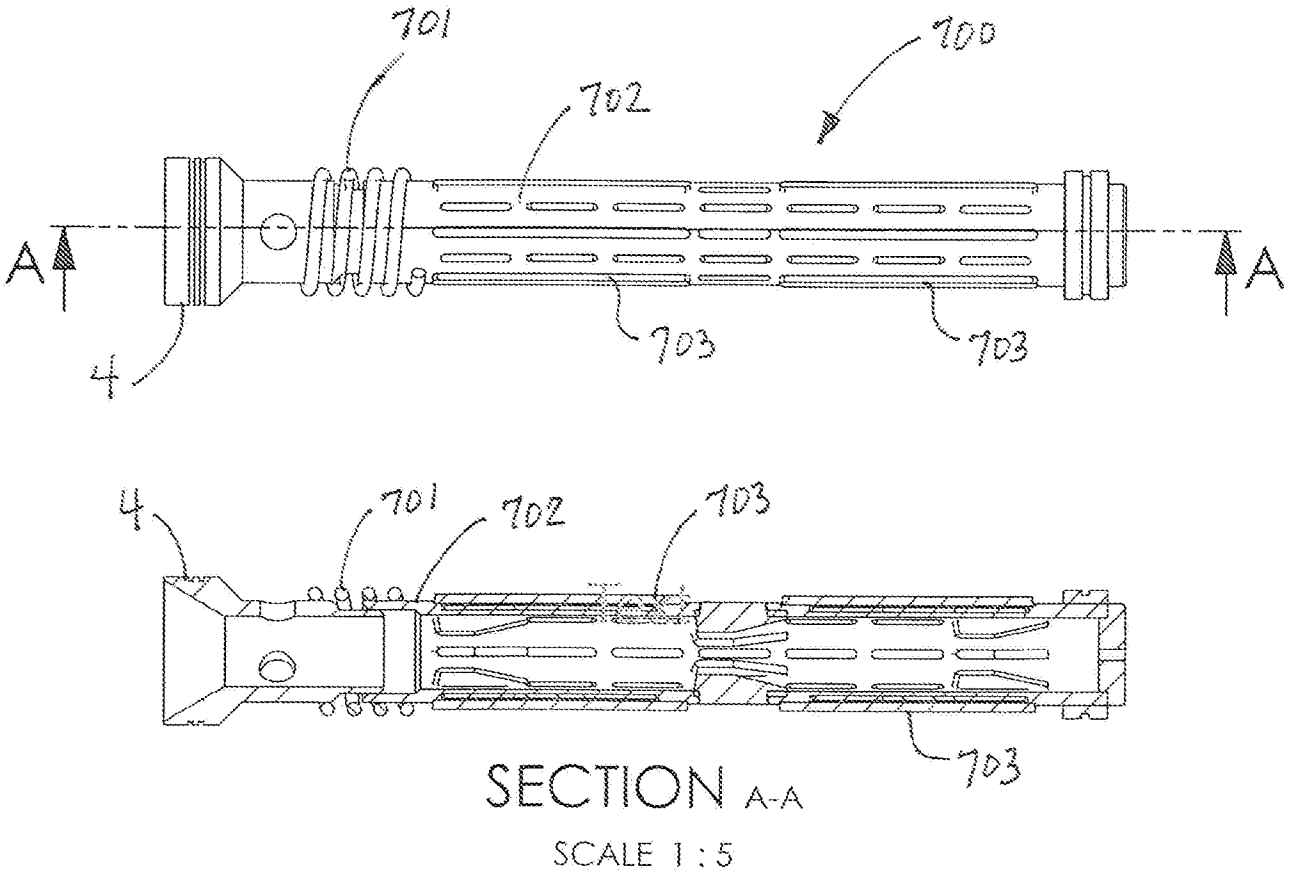
FIG. 7 shows an internal diffuser assembly which includes a resilient member to enable a vibration feature, and having a slotted diffuser section which includes a plurality of magnets aligned with the slots.

With reference to FIG. 7, an internal diffuser assembly 700 is shown which includes a resilient member 701 extending from the mounting member 4 to enable a vibration feature as previously described in the applicants' other patents and applications incorporated herein. This embodiment includes a slotted internal diffuser section 702 which includes a plurality of elongated magnets 703 aligned with the slots, as previously described herein.

Figure 8:
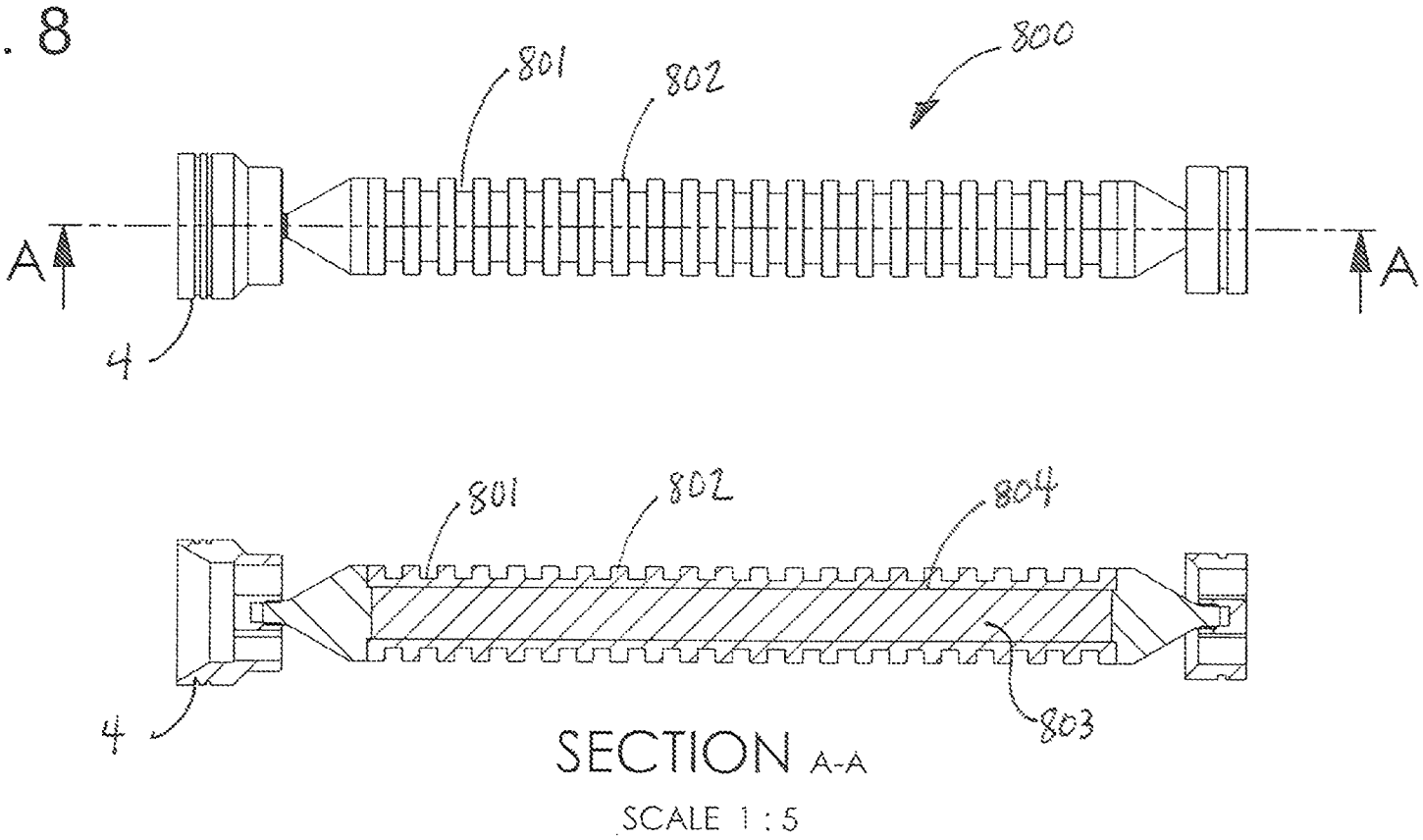
FIG. 8 shows a magnetic debris collector having a central member which includes a ribbed profile, and which further includes one or more magnets within an enclosed chamber in the central member.

With reference to FIG. 8, a magnetic debris collector 800 is shown having a central member 801 which includes a ribbed profile 802, and which further includes one or more magnets 803 within an enclosed chamber 804 in the central member 801. The sole function of this embodiment is to attract and retain metal debris in situations where filtration or diffusion is not required.

Figure 9:
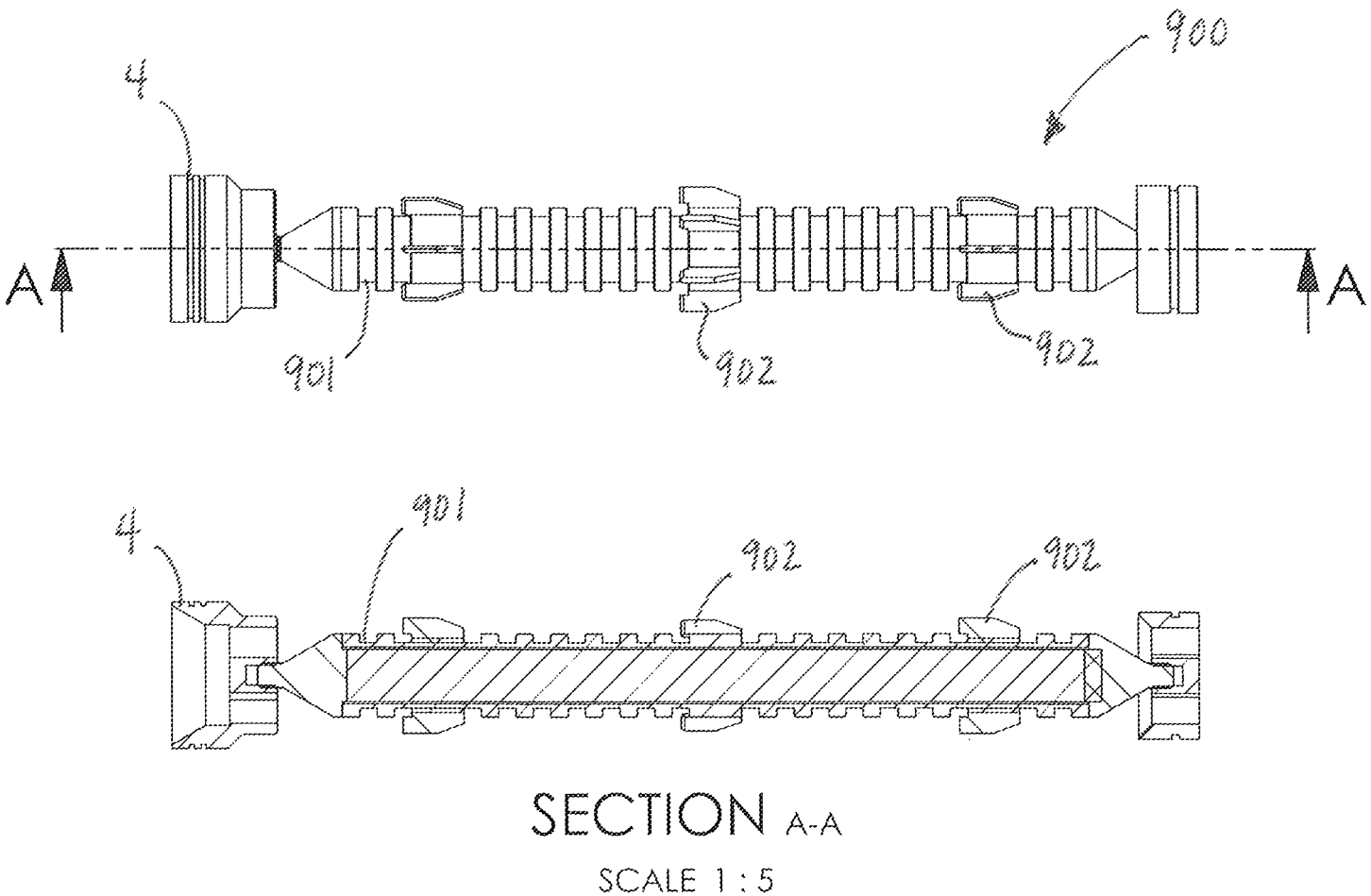
FIG. 9 shows an external diffuser assembly having a central member which includes a ribbed profile, and which further includes one or more magnets within an enclosed chamber in the central member.

With reference to FIG. 9, an external diffuser assembly 900 is shown which is identical in all respects to the magnetic debris collector 800 of FIG. 8, but with the addition of external diffusing elements 902 along the length of the central member 901.

Figure 10:
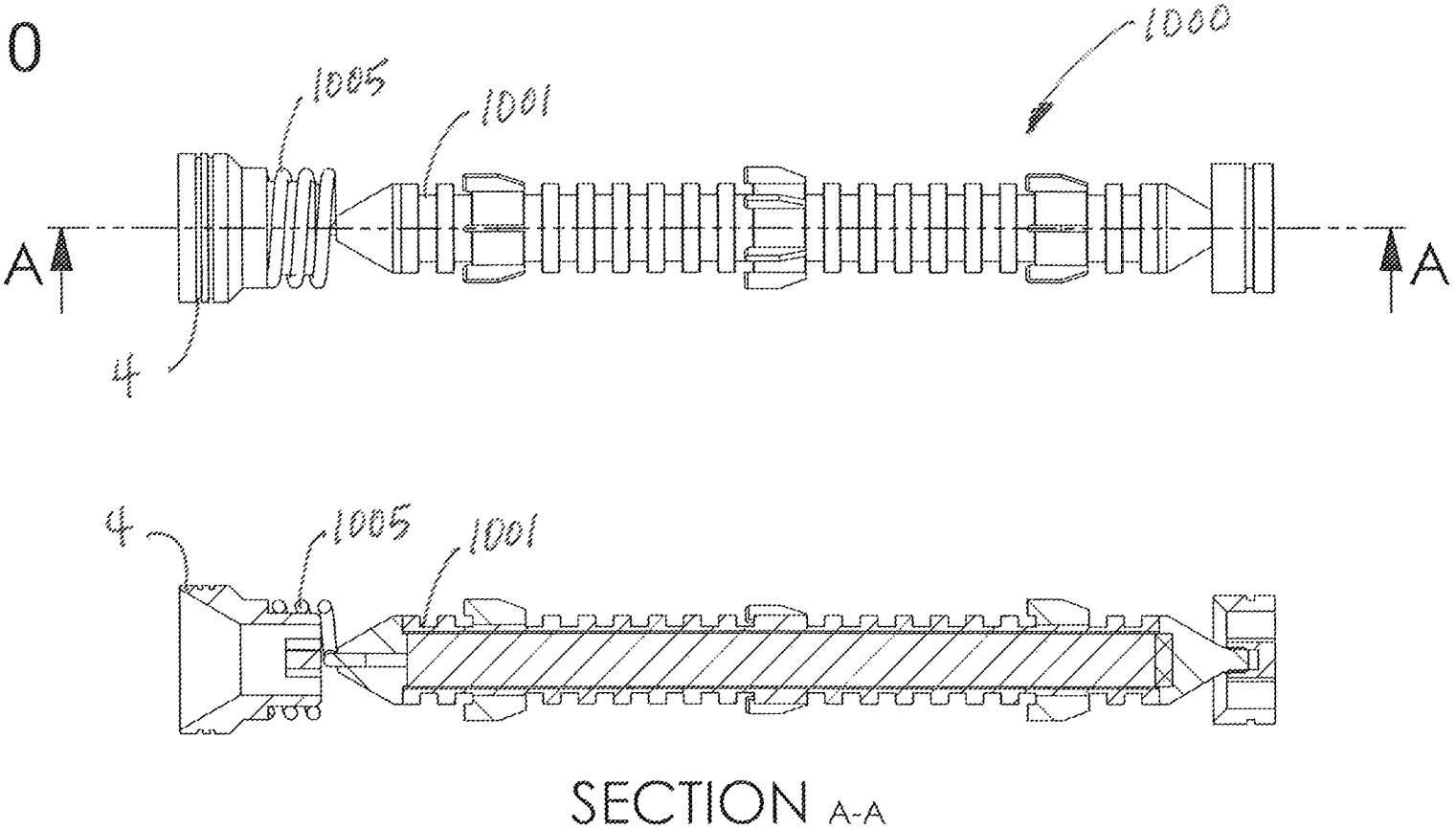
FIG. 10 shows an external diffuser assembly which includes a resilient member to enable a vibration feature, and having a central member which includes a ribbed profile, and which further includes one or more magnets within an enclosed chamber in the central member.

With reference to FIG. 10, an external diffuser assembly 1000 is shown which is identical in all respects to the external diffuser assembly 900 of FIG. 9, but with the addition of the resilient element 1005 between the mounting member 4 and the central member 1001.

Figure 11A:
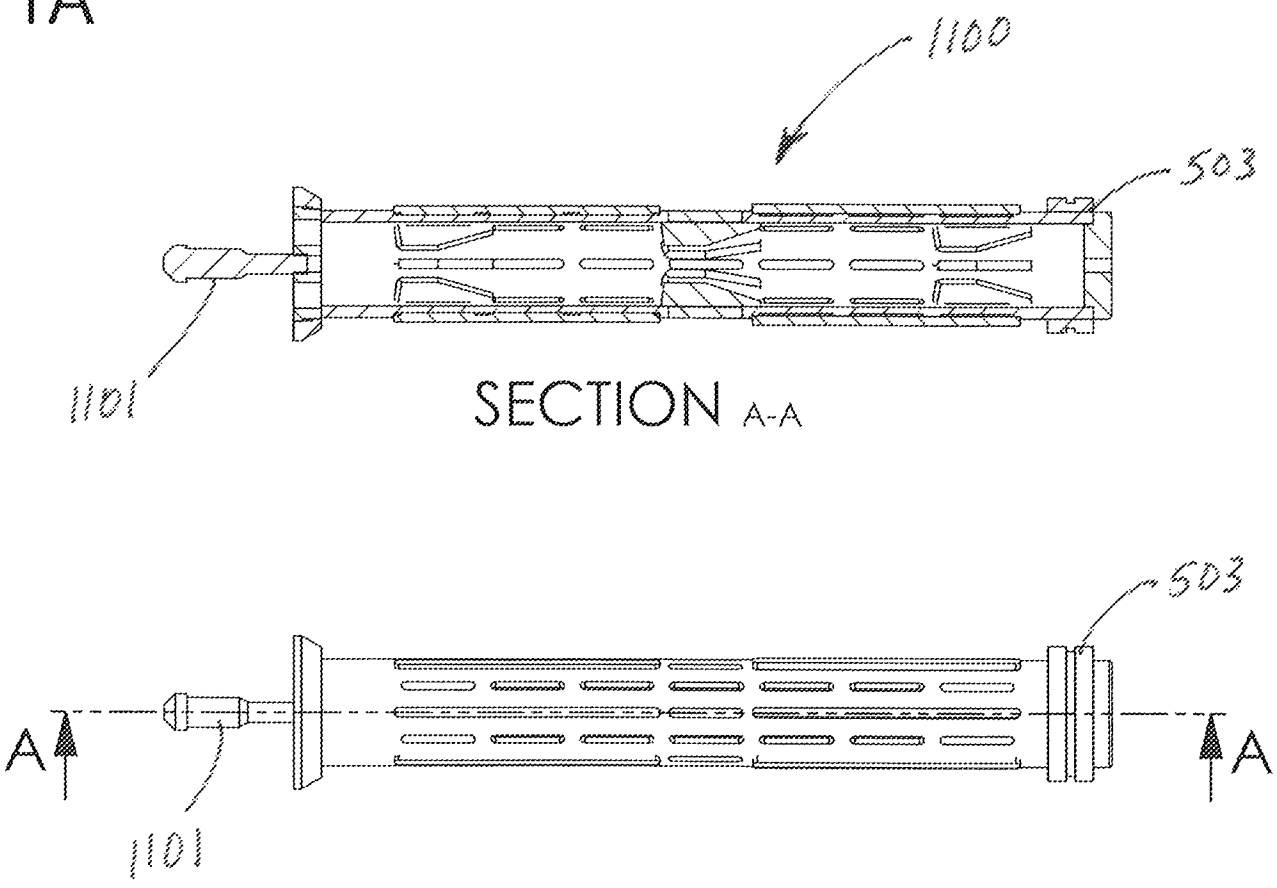
FIGS. 11A and 11B show an internal diffuser with and without a retrievable neck.
Figure 11B:
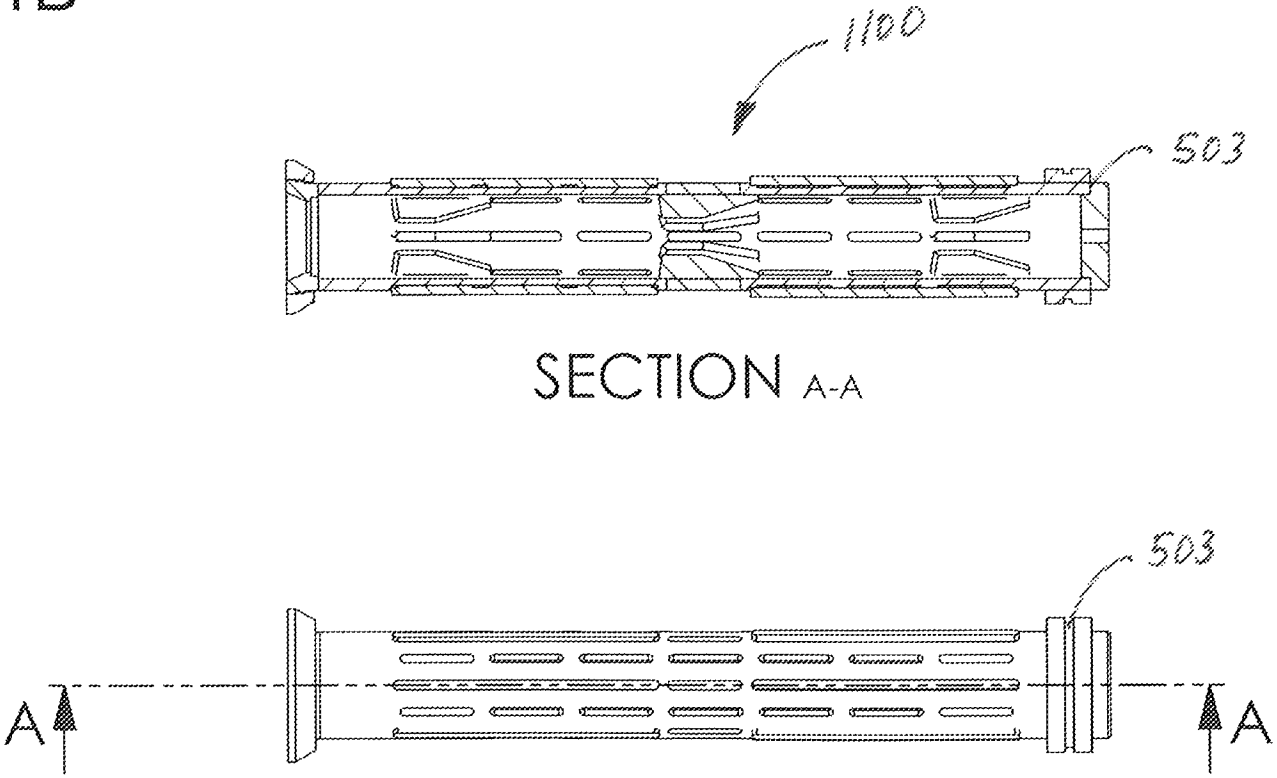
Figure 12A:
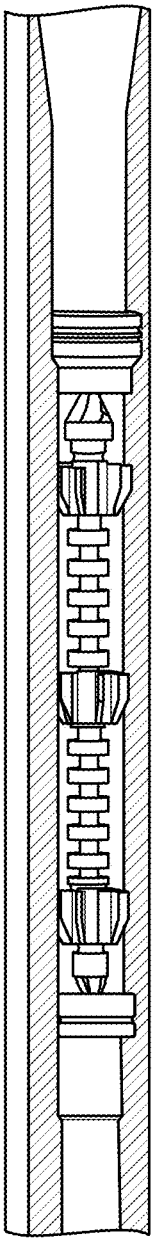
FIGS. 12A-12E show the manner in which any of the various embodiments of FIGS. 1-11B may be deployed within a carrier sub or drill pipe.
Figure 12B:
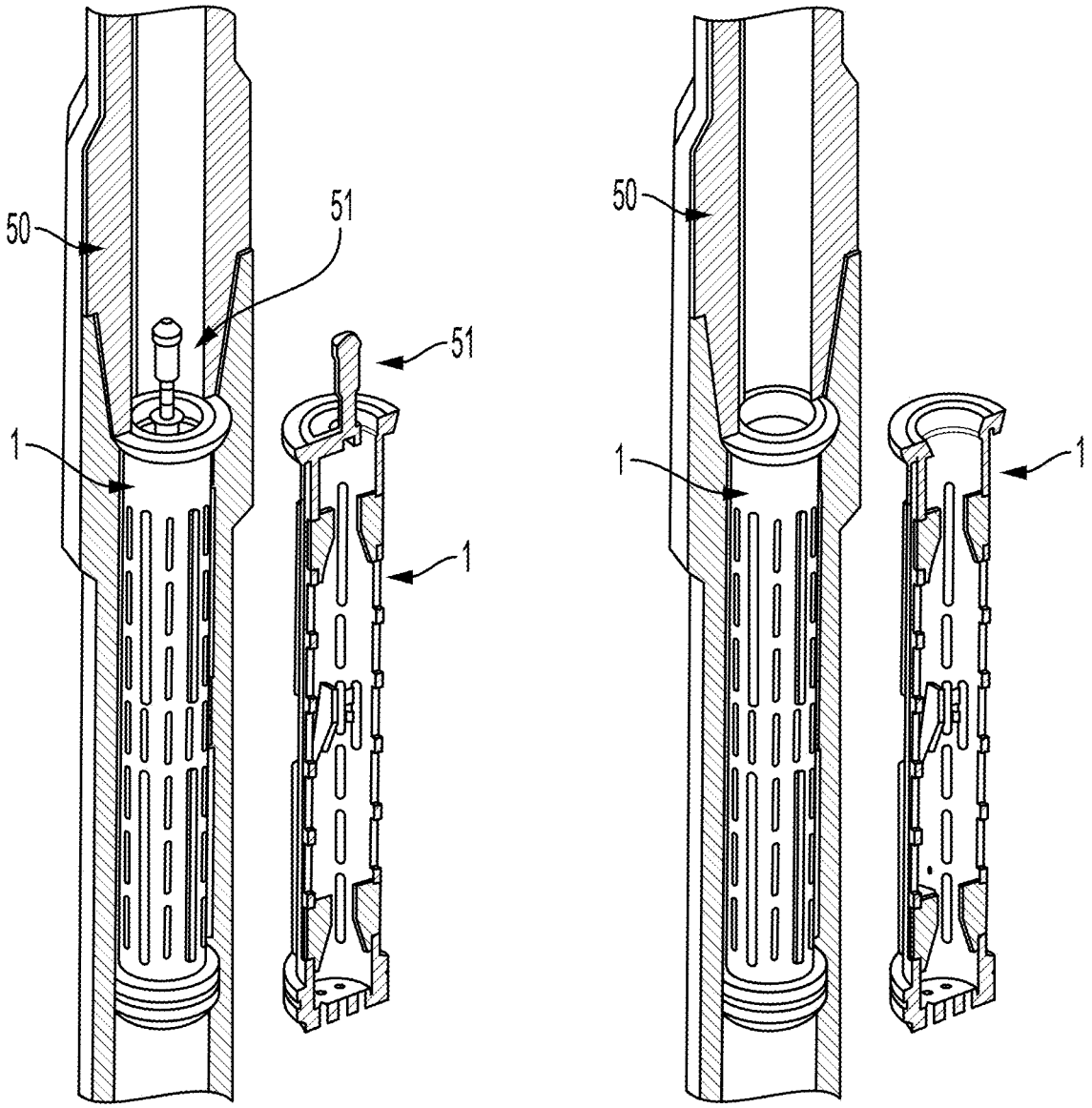
Figure 12C:
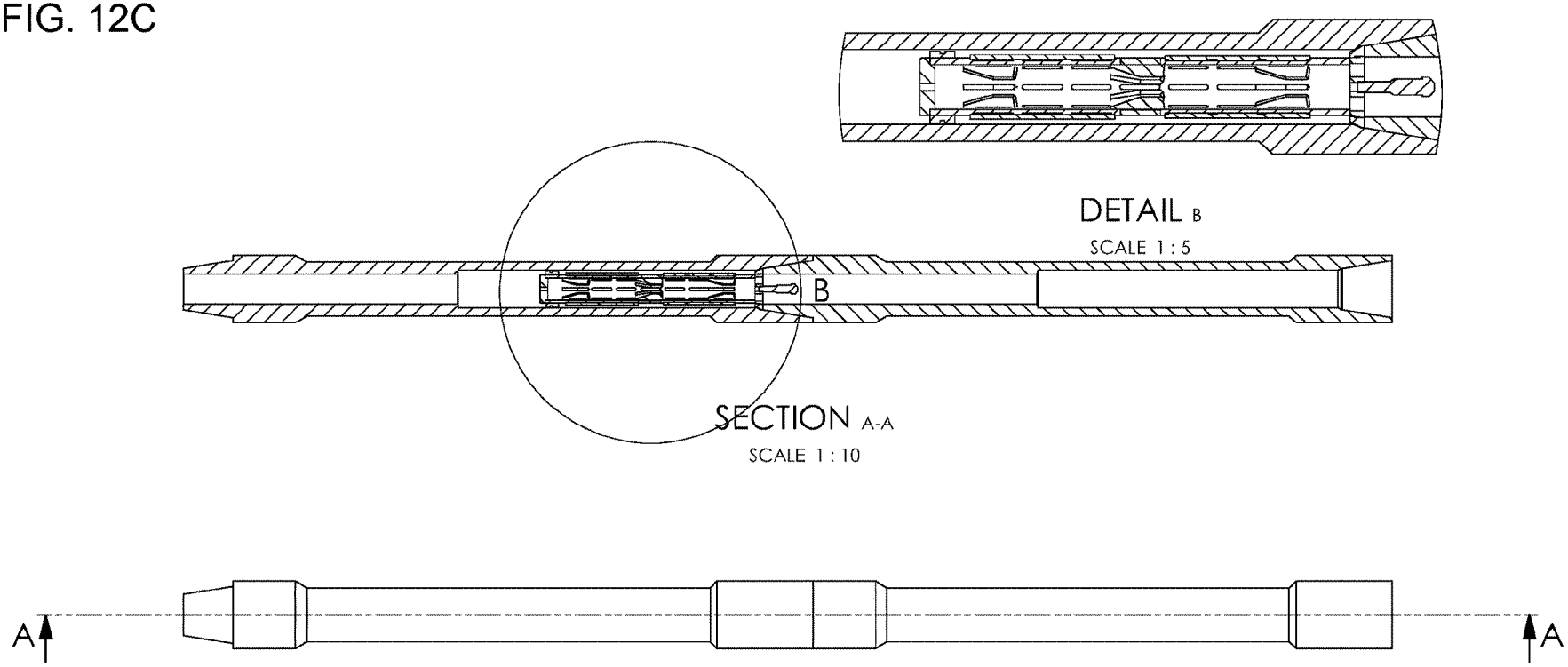
Figure 12D:
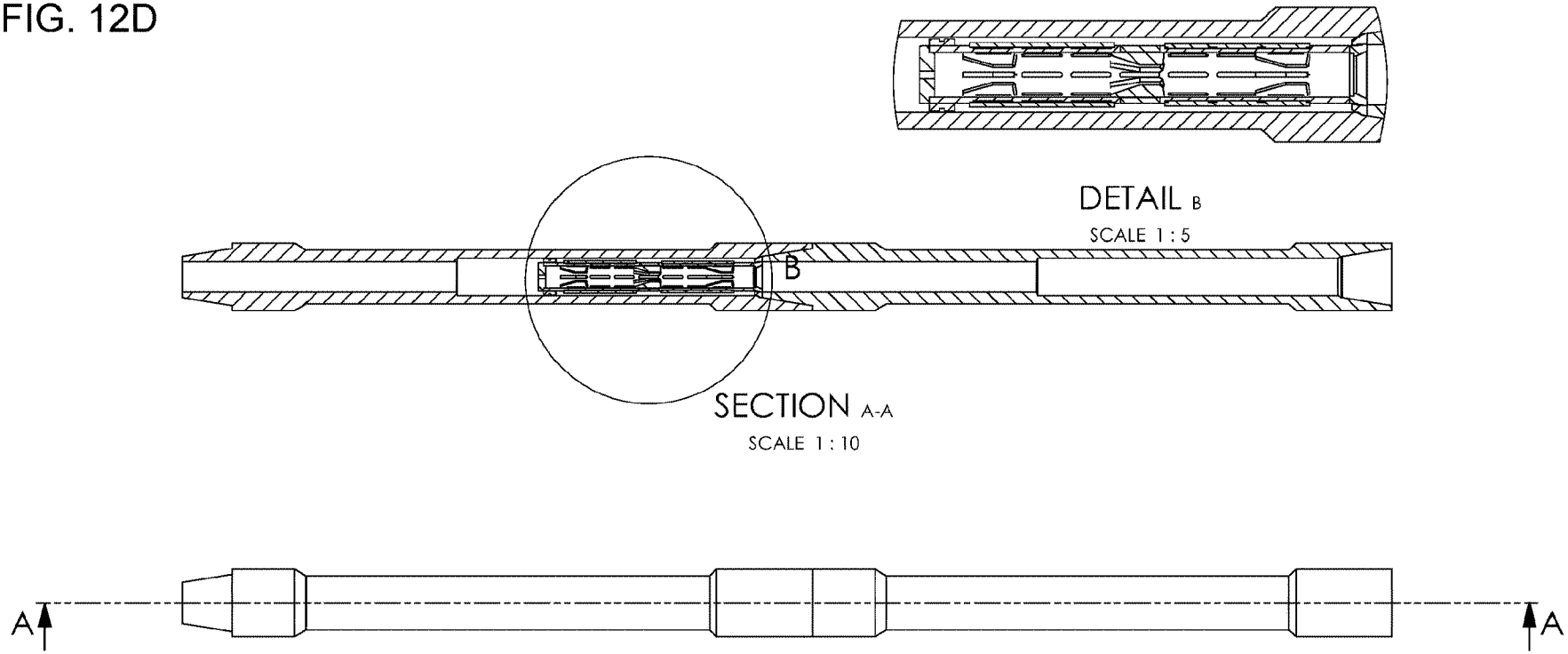
Figure 12E:
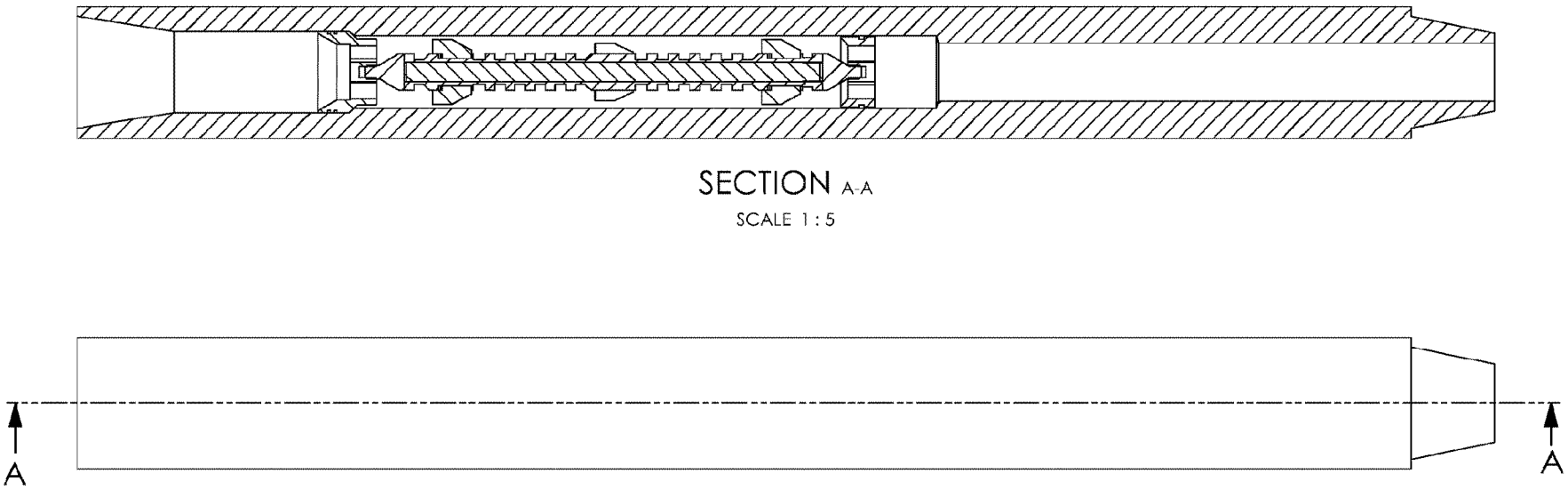
Figure 13A:
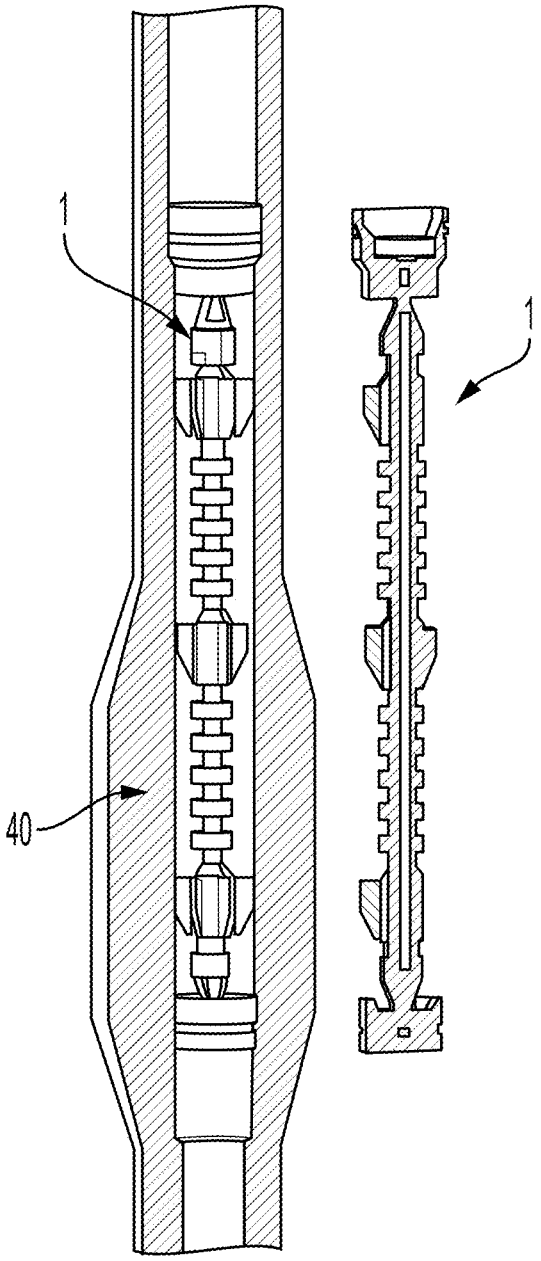
FIGS. 13A and 13B show the manner in which any of the various embodiments of FIGS. 1-11B may be deployed within a stabilizer.
Figure 13B:
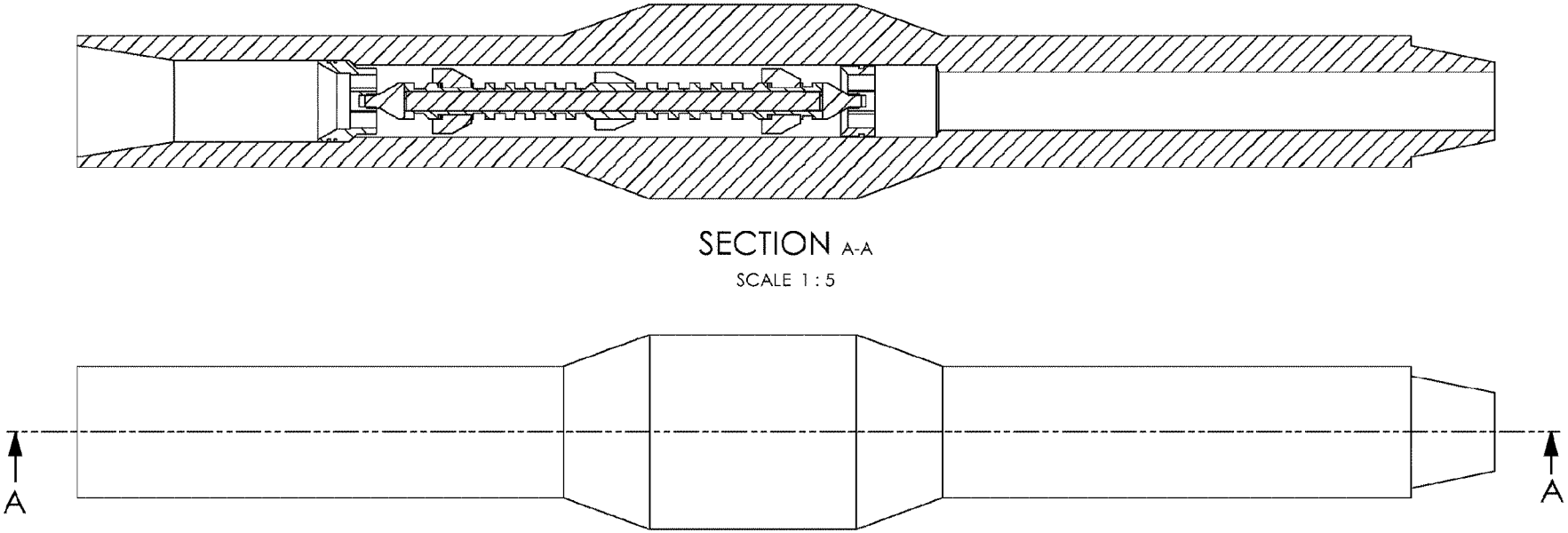

With reference to FIGS. 11A and 11B, an internal diffuser 1100 is shown which is similar in most respects to the embodiment of FIG. 5. FIG. 11A illustrates the inclusion of a retrievable neck 1101 for temporary placement of the diffuser 1100 into a preferred location, whereas FIG. 10 11B illustrates a non-retrievable embodiment. Both of the embodiments of FIGS. 11A and 11B include the optional end cap 503.

As will be understood, the embodiments depicted in all of the figures may be modified to suit a wide range of operational environments and combinations of features. For example, the magnetic collars 11, 12, the internal or external filter or diffuser, the elongated magnets 202, the ribbed central member with magnets in an internal chamber, and the vibration feature may be effectively mixed and matched to build a specific embodiment that is ideally suited to a job requiring those features.

Figure 14:
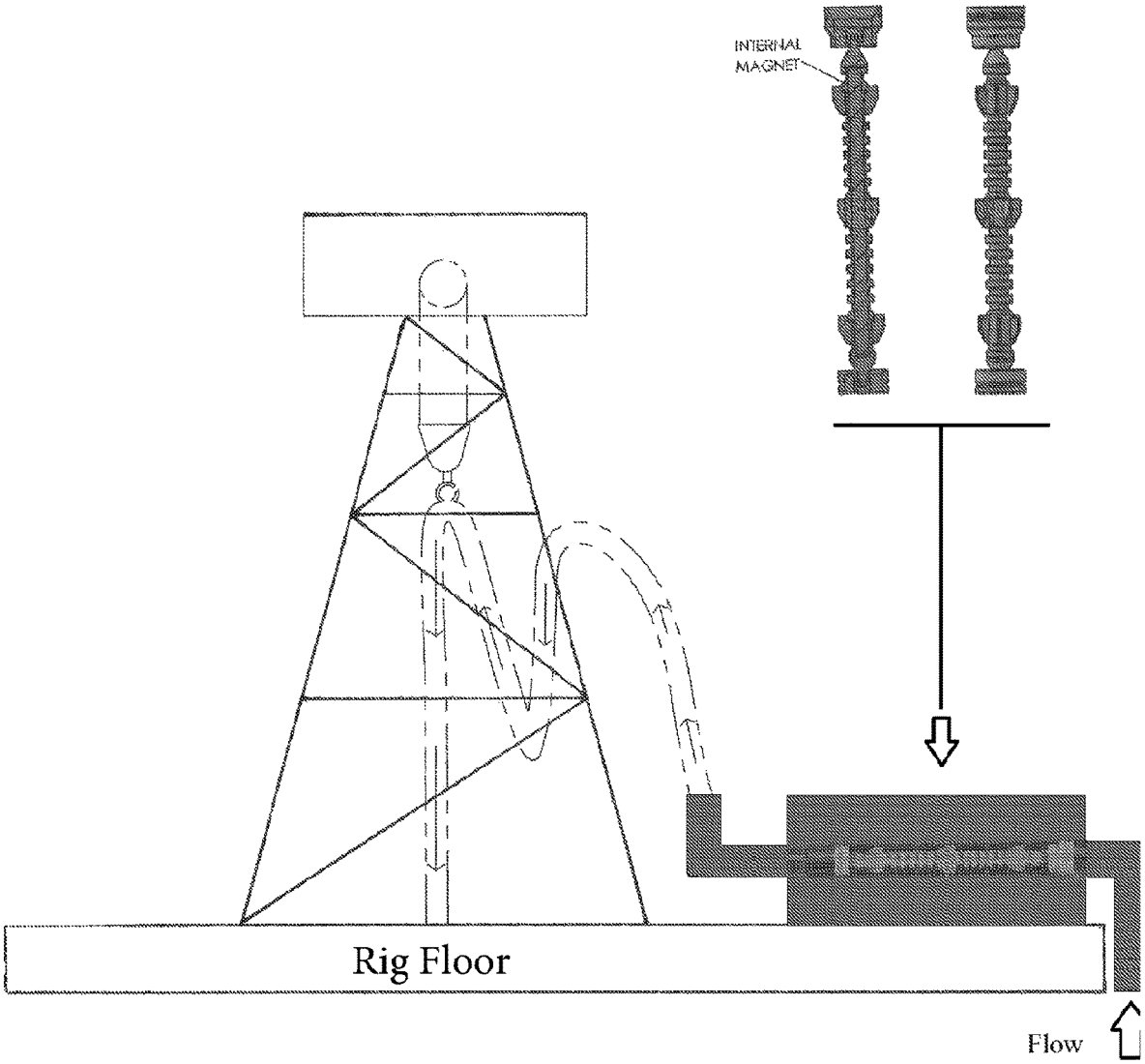
FIG. 14 shows the manner in which any of the various embodiments of FIGS. 1-11B may be deployed at the rig floor.
Figure 15:
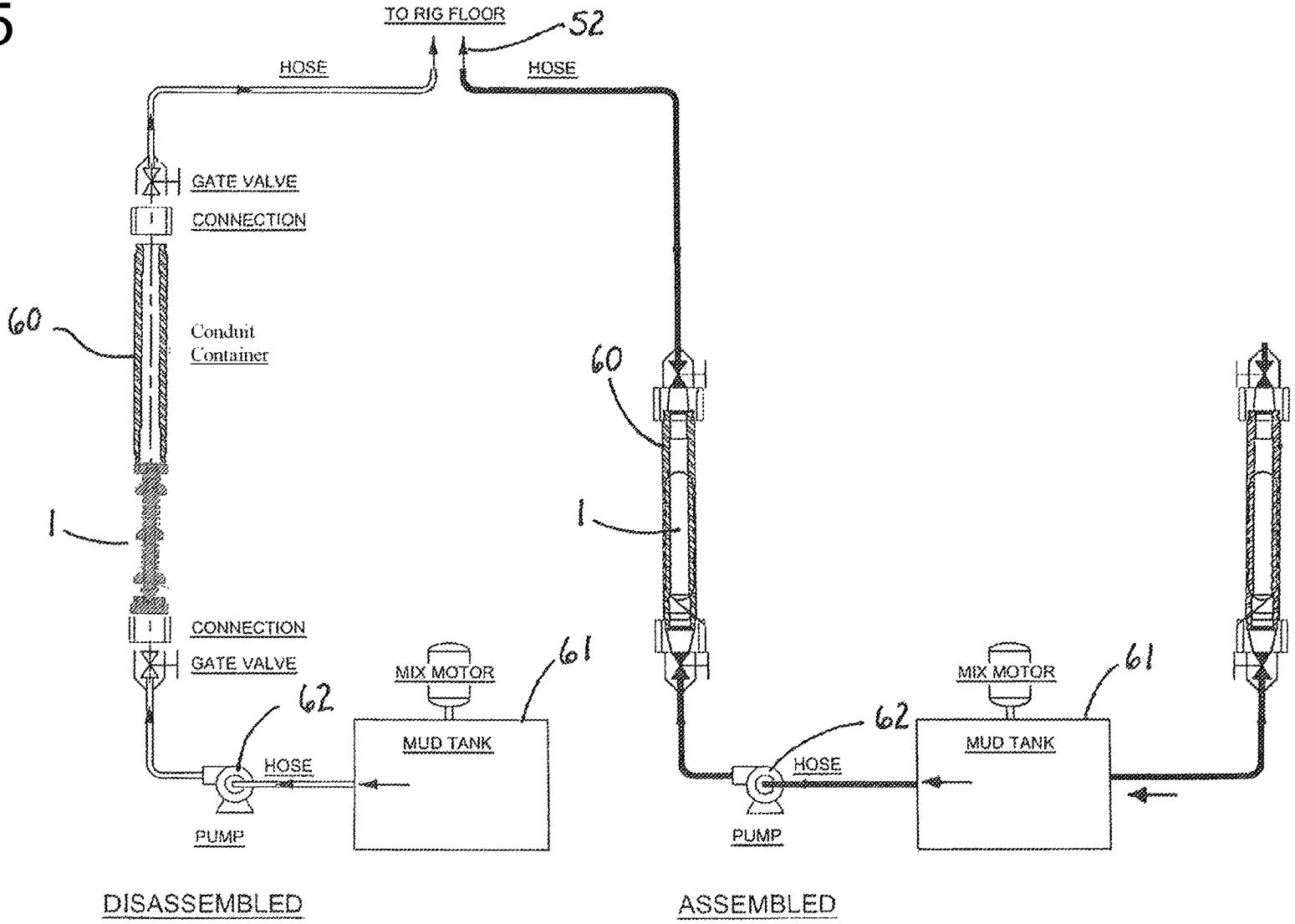
FIG. 15 shows the manner in which any of the various embodiments of FIGS. 1-11B may be deployed within a conduit between a drilling fluid mixing tank and the rig floor, or prior to flow into a drilling fluid mixing tank.

As explained above with respect to the other embodiments disclosed herein, the embodiments of all of the figures are not limited to application for downhole use within a carrier sub or drill pipe as shown in FIGS. 12A-12E. Rather, they are equally suitable for use in other environments where diffusion, filtration, or magnetic attraction are required, such as the stabilizer of FIGS. 13A and 13B, deployment at the level of the rig floor as shown in FIG. 14 prior to injection of drilling fluids, and deployment within a conduit 60 between a drilling fluid mixing tank 61 and the rig floor 52, or prior to flow into a drilling fluid mixing tank 61 as shown in FIG. 15.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. An assembly for use in a conduit and for removing metal debris, comprising:

(a) a mounting member for positioning the assembly in the conduit; and (b) a central member below the mounting member, wherein the central member includes an enclosed internal chamber, and wherein the internal chamber includes a plurality of magnets disposed within the central member;

(c) a slotted filter attached below the central member;

(d) a first plurality of radially disposed diffusing elements attached to the central member; and (e) a second plurality of radially disposed diffusing elements attached to the central member, wherein the diffusing elements of the second plurality of diffusing elements are angularly offset from the first plurality of diffusing members.

2. The assembly of claim 1, wherein the assembly is positioned within a downhole carrier sub inside a well bore.

3. The assembly of claim 1, wherein the assembly is positioned within a stabilizer.

4. The assembly of claim 1, wherein the assembly is positioned within a drill pipe at a rig floor.

5. The assembly of claim 1, wherein the assembly is positioned within a pipe in fluid communication between a mixing tank and a rig floor.

6. An assembly for use in a downhole conduit in communication with a drilling platform and for removing metal debris, comprising:

(a) a mounting member for positioning the assembly in the downhole conduit;

(b) a central member having a plurality of magnets disposed within an enclosed internal chamber of the central member;

(c) an upper collar attached above the central member, and a lower collar attached below the central member;

wherein the central member includes a first plurality of radially disposed diffusing elements attached to the central member; and wherein the central member includes a second plurality of radially disposed diffusing elements attached to the central member and angularly offset from the first plurality of diffusing members.

7. The assembly of claim 6, wherein the assembly further includes a slotted filter attached below the central member.

* * * * *